US009841706B2

(12) United States Patent
Shigihara et al.

(10) Patent No.: US 9,841,706 B2
(45) Date of Patent: Dec. 12, 2017

(54) IMAGE FORMING APPARATUS

(71) Applicant: CANON KABUSHIKI KAISHA, Tokyo (JP)

(72) Inventors: Keita Shigihara, Toride (JP); Toshiya Fukazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/220,529

(22) Filed: Jul. 27, 2016

(65) Prior Publication Data

US 2017/0031274 A1 Feb. 2, 2017

(30) Foreign Application Priority Data

Jul. 30, 2015 (JP) ..... 2015-151221

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 5,960,239 A * 9/1999 Toyoshima ..... G03G 15/0812 399/284
6,186,066 B1 * 2/2001 Kim ..... G03G 15/11 101/423
7,702,266 B2 4/2010 Kazaki et al.
2001/0009617 A1 * 7/2001 Okamoto ..... G03G 15/161 399/101
2002/0051659 A1 * 5/2002 Baba ..... G03G 15/161 399/307
2006/0216077 A1 * 9/2006 Komuro ..... G03G 15/206 399/328
2007/0172278 A1 * 7/2007 Yamamoto ..... G03G 15/6576 399/405
2008/0240809 A1 * 10/2008 Takahashi ..... G03G 15/2064 399/329
2010/0290823 A1 * 11/2010 Okabe ..... G03G 15/2064 399/331
2010/0296849 A1 * 11/2010 Yamamoto ..... G03G 15/657 399/329
2011/0211883 A1 * 9/2011 Ferrar ..... G03G 15/161 399/350
2011/0255909 A1 * 10/2011 Tomura ..... G03G 15/0131 399/308

(Continued)

FOREIGN PATENT DOCUMENTS

JP H10-10864 A 1/1998
JP 2005-338587 A 12/2005
JP 2007-140062 A 6/2007

*Primary Examiner* — David Bolduc
(74) *Attorney, Agent, or Firm* — Fitzpatrick, Cella, Harper & Scinto

(57) ABSTRACT

An image forming apparatus includes a movable member unit including a movable member, and a container connectable with the movable member unit and including a cleaning member, a sheet member and an urging member. When a friction coefficient between the sheet member and the movable member is μ1 and a friction coefficient between the sheet member and the urging member is μ2, the following relationship is satisfied: μ1>μ2.

10 Claims, 5 Drawing Sheets

(56) References Cited

U.S. PATENT DOCUMENTS

| | | | | |
|---|---|---|---|---|
| 2011/0318069 | A1* | 12/2011 | Nishizawa | G03G 15/161 399/308 |
| 2012/0020693 | A1* | 1/2012 | Yamaki | G03G 15/161 399/71 |
| 2012/0121288 | A1* | 5/2012 | Yagi | G03G 21/12 399/101 |
| 2012/0199443 | A1* | 8/2012 | Kaneyama | G03G 15/161 198/496 |
| 2012/0301176 | A1* | 11/2012 | Ferrar | G03G 15/161 399/101 |
| 2015/0268591 | A1* | 9/2015 | Fujita | G03G 15/1615 399/121 |

* cited by examiner (a)

(b)

IMAGE FORMING APPARATUS

FIELD OF THE INVENTION AND RELATED ART

The present invention relates to an image forming apparatus including a container for accommodating powder and a rotatable member mounted to the container.

Conventionally, in the image forming apparatus using an electrophotographic type or an electrostatic recording type, a toner image is formed on a drum-shaped or belt-shaped electrophotographic photosensitive member or electrostatic recording dielectric member by an appropriate image forming process. This toner image is directly transferred onto a transfer(-receiving) material (direct transfer type) or is secondary-transferred onto the transfer material after being once primary-transferred onto an intermediary transfer member (intermediary transfer type. In transfer of the toner image from an image bearing member such as a photosensitive member, an electrostatic recording dielectric member or an intermediary transfer member onto a transfer-receiving member, for example, a transfer member provided so as to be contactable to the image bearing member is used. In such an image forming apparatus, a cleaning means for collecting toner from the image bearing member or the transfer member is provided. Toners to be collected include, for example, toner (transfer residual toner) remaining on the members after a transfer step, toner (fog toner) deposited on a non-image region, and toner (patch toner) of various control images.

For example, in an image forming apparatus of an intermediary transfer type using an electrophotographic process, patches for positioned alignment between the image and a transfer material and for adjusting a color that are formed on the intermediary transfer member in some cases. The patches on the intermediary transfer member are formed in the non-image region such as a region (sheet interval) between an image and a subsequent image, and therefore are transferred onto a secondary transfer member in some cases. The toner transferred on the secondary transfer member is removed by the cleaning means and is collected in a cleaning container. As the secondary transfer member, a rotatable member such as a roller or an endless belt wound around a plurality of rollers is used. In this image forming apparatus, when a gap is formed between the secondary transfer member and the cleaning container, the toner scatters to an outside through the gap, so that an inside of the image forming apparatus is contaminated with the toner. Therefore, the gap between the secondary transfer member and the cleaning container has been sealed with a seal (sealing) member. In the image forming apparatus, the seal member has been widely used for filling (closing) the gap not only between the secondary transfer member and the cleaning container but also between a container for accommodating powder and a rotatable member.

As the seal member, a brush-shaped member formed with furs of synthetic fibers or a sheet-shaped member formed of PET (PET sheet) is used in some cases. In the case where the brush-shaped member or the PET sheet is used, a contact pressure to the rotatable member is liable to become relatively large, so that fusion of the toner to the rotatable member is liable to generate. On the other hand, as the seal member, a sheet-shaped member formed of polyurethane (urethane sheet) is used in some cases. The polyurethane sheet is relatively low in rigidity and the contact pressure to the rotatable member does not readily become excessive, and therefore, it can be said that the urethane sheet is a seal member suitable for a portion where the seal member directly slides with the toner.

Japanese Laid-Open Patent Application 2007-140062 discloses that the urethane sheet is contacted to a surface of a photosensitive member in order to suppress scattering of a toner through a gap between the photosensitive member and a developing device.

However, in the case where the sheet-shaped seal member (hereinafter simply referred to as a sheet member) such as the urethane sheet described above is used, it turned out that the following problem arose.

That is, when the rotatable member is mounted to the container, the sheet member enters a portion below the rotatable member. For that reason, the sheet member is checked by eye observation during an operation such as during assembling or when the rotatable member is replaced by a service person and then is required to be pulled out (turned up) to a normal position by a manual operation in some cases. Thus, the pulling-out of the sheet member complicates the operation and causes damage of the rotatable member and the sheet member.

In this regards, it would be considered that a constitution in which the sheet member is made detachably mountable to the container and is mounted to the container after the rotatable member is mounted during replacement or the like of the rotatable member or the sheet member is retracted from the rotatable member is synchronism with mounting and demounting of the rotatable member. However, in this case, complification and upsizing of a device constitution are liable to generate.

SUMMARY OF THE INVENTION

According to an aspect of the present invention, there is provided an image forming apparatus comprising: a movable member unit including a movable member on which a toner image is carried or a movable member configured to feed a recording material on which the toner image is carried, wherein the movable member unit movably supports the movable member; and a container connectable with the movable member unit and including a cleaning member, a sheet member and an urging member, wherein the cleaning member removes a toner on the movable member with movement of the movable member in contact with the movable member in a state in which the movable member unit and the container are connected with each other, wherein the sheet member extends in a widthwise direction perpendicular to a movement direction of the movable member and is supported by the container in one end side thereof with respect to the movement direction of the movable member, and at least during cleaning of the movable member, a part of the sheet member in the other end side where a free end of the sheet member is positioned in a first state in which the part of the sheet member contacts the movable member codirectionally with the movement direction of the movable member, wherein the urging member is adjacent to the sheet member in an upstream side of the sheet member with respect to the movement direction of the movable member and is disposed at a position overlapping with neighborhoods of ends of the sheet members with respect to the widthwise direction, and the part of the sheet member in the other side where the free end of the sheet member is positioned is in a second state in which the part of the sheet member is sandwiched between the movable member and the urging member counterdirectionally with the movement direction of the movable member when the movable member unit and the container are connected with each other, and wherein when a friction coefficient between the sheet member and the movable member is μ1 and a friction coefficient between the sheet member and the urging member is μ2, the following relationship is satisfied: μ1>μ2.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Constitution and Operation of Image Forming Apparatus

Figure 1:
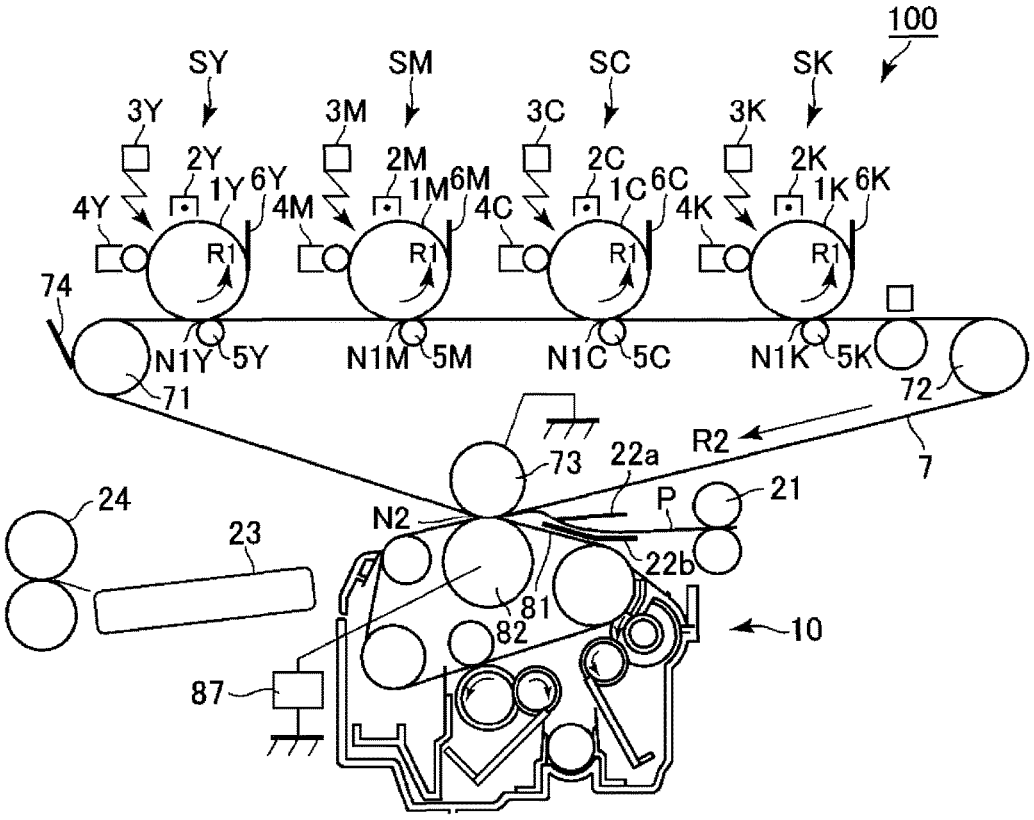
FIG. 1 is a schematic sectional view of an image forming apparatus.

FIG. 1 is a schematic sectional view of an image forming apparatus 100 according to Embodiment 1 of the present invention.

The image forming apparatus 100 in this embodiment is a tandem laser beam printer which is capable of forming a full-color image using an electrophotographic type and which employs an intermediary transfer type.

The image forming apparatus 100 includes, as a plurality of image forming portions (stations), first to fourth image forming portions SY, SM, SC and SK for forming images of yellow (Y), magenta (M), cyan (C) and black (K), respectively. In this embodiment, constitutions and operations of these four image forming portions SY, SM, SC and SK are substantially the same except that the colors of toners used in a developing step described later are different from each other. Accordingly, in the following, in the case where particular distinction is not required, suffixes Y, M, C and K for representing elements for associated colors are omitted, and the elements will be collectively described.

The image forming portion S includes a photosensitive drum 1 which is a drum-shaped electrophotographic photosensitive member as a first image bearing member. The photosensitive drum 1 is rotationally driven in an arrow R1 direction. At a periphery of the photosensitive drum 1 of the image forming portion S, along a rotational direction of the photosensitive drum 1, the following process devices are provided in the listed order. First, a charger 2 as a charging means is disposed. Next, an exposure device (laser scanner) 3 as an exposure means is disposed. Next, a developing device 4 as a developing means is disposed. Next, primary transfer rollers 5 which are roller-shaped primary transfer members as primary transfer means. Next, a drum cleaning device 6 as a photosensitive member cleaning means is disposed.

A surface of the rotating photosensitive drum 1 is electrically charged substantially uniformly to a predetermined polarity (negative in this embodiment) and a predetermined potential by the charger. The charged photosensitive drum 1 is exposed to light depending on image information by the exposure device 3, so that an electrostatic latent image (electrostatic image) depending on the image information is formed on the photosensitive drum 1. The electrostatic latent image formed on the photosensitive drum 1 is developed (visualized) with the toner as a developer by the developing device 4, so that the toner image is formed on the photosensitive drum 1. The developing device 4 includes a developer container for accommodating the toner and a developing roller as a developer carrying member rotatably provided to the developer container, and supplies the toner, fed to an opposing portion to the photosensitive drum 1 while being carried on a surface of the rotating developing roller, to the photosensitive drum 1 depending on the electrostatic latent image. In this embodiment, a reverse developing method is used. That is, the toner charged to the same polarity as a charge polarity of the photosensitive drum 1 is deposited on an exposed portion of the photosensitive drum 1 where an absolute value of the potential is lowered by exposing to light the surface of the photosensitive drum 1 after the photosensitive drum 1 is uniformly charged.

Incidentally, the electrostatic latent image formed by the exposure device 3 is a group of small dotted images, and by changing a density of the dotted images, it is possible to change a density of the toner image to be formed on the photosensitive drum 1. In this embodiment, each of the color toner images is about 1.5-1.7 in maximum density, and is about 0.4-0.6 mg/cm$^2$ in toner amount per unit area at the maximum density.

As a second image bearing member, an intermediary transfer belt 7 constituted by a rotatable endless belt is provided in contact with the surfaces of the photosensitive drums 1Y, 1M, 1C, 1K of the image forming portions SY, SM, SC, SK. The intermediary transfer belt 7 is stretched by a plurality of stretching rollers (supporting members) including a driving roller 71, a tension roller 72, and a secondary transfer opposite roller 73. The driving roller 71 transmits a driving force from a driving motor (not shown) as a driving means to the intermediary transfer belt 7 and thus moves (rotates) the intermediary transfer belt 7. The intermediary transfer belt 7 is rotationally driven by the driving roller 71 in an arrow R1 direction in FIG. 1. In this embodiment, a peripheral speed of the intermediary transfer belt is 250-300 mm/sec. The tension roller 72 controls the tension of the intermediary transfer belt 7 at a constant level. The secondary transfer opposite roller 73 opposes a secondary transfer roller 82 described later via the intermediary transfer belt 7 and a secondary transfer belt 81 described later, so that a secondary transfer portion (secondary transfer nip) N2 is formed.

As the intermediary transfer belt 7, a belt prepared by incorporating carbon black as an antistatic agent in an appropriate amount into a resin material such as polyimide or polycarbonate, or various rubbers may suitably be used, for example. The intermediary transfer belt 7 may preferably have a volume resistivity of about $1\times10^{9}$-$1\times10^{14}$ Ω·cm and a thickness of about 0.07-0.1 mm.

In the inner peripheral surface (back surface) side of the intermediary transfer belt 7, the above-described primary transfer rollers 5Y, 5M, 5C, 5K are disposed corresponding to the photosensitive drums 1Y, 1M, 1C, 1K, respectively. Each primary transfer roller 5 is urged toward an associated photosensitive drum 1 via the intermediary transfer belt 7, so that a primary transfer portion (primary transfer nip) N1 where the intermediary transfer belt 7 and the photosensitive drum 1 contact each other is formed. Further, in the outer peripheral surface (front surface) side of the intermediary transfer belt 7, at a position opposing a secondary transfer device 10 as a secondary transfer means is provided. As specifically described later, the secondary transfer device 10 includes a secondary transfer belt 81 constituted by an endless belt and includes a secondary transfer roller 82 disposed in an inner peripheral surface side of the secondary transfer belt 81. The secondary transfer roller 82 is urged toward the secondary transfer opposite roller 73 via the intermediary transfer belt 7 and the secondary transfer belt 81, so that the secondary transfer portion (secondary transfer nip) N2 where the intermediary transfer belt 7 and the secondary transfer belt 81 contact each other is formed. Further, in the outer peripheral surface side of the intermediary transfer belt 7, at a position opposing the driving roller 71, an intermediary transfer belt cleaner 24 as an intermediary transfer member cleaning means is provided.

The toner image formed on the photosensitive drum 1 as described above is electrostatically transferred (primary-transferred) onto the rotating intermediary transfer belt 7 by the action of the primary transfer roller 5 at the primary transfer portion N1. At this time, to the primary transfer roller 5, a primary transfer bias (primary transfer voltage) of an opposite polarity (positive in this embodiment) to a normal charge polarity of the toner is applied. As a result, a primary transfer current is supplied to the primary transfer portion N1. For example, during full-color image formation, the respective color toner images formed on the photosensitive drums 1Y, 1M, 1C, 1K are successively transferred superposedly onto the intermediary transfer belt 7 at the respective primary transfer portions N1. As a result, multiple toner images, for a full-color image, obtained by the superposed four color toner images are formed on the intermediary transfer belt 7. A deposited matter such as the toners (primary-transfer residual toners) remaining on the photosensitive drums 1 after the predetermined transfer step is removed and collected from the photosensitive drums 1 by the drum cleaners 6.

The toner images formed on the intermediary transfer belt 7 are sent to the secondary transfer portion N2 by rotation of the intermediary transfer belt 7. On the other hand, the transfer material (recording material) P, such as paper, accommodated in a transfer material cassette (not shown) is fed one by one by a feeding roller (not shown) and then is fed to the secondary transfer portion N2 by a registration roller pair 21. The registration roller pair 21 once stops the fed transfer material P and then supplies the transfer material P to the secondary transfer portion N2 in synchronism with the feeding of the toner images on the intermediary transfer belt 7 to the secondary transfer portion N2. With respect to the feeding direction of the transfer material P, on a side upstream of the secondary transfer portion N2, the following guiding members 22*a* and 22*b* as feeding guides for regulating a feeding path of the transfer material P are provided. First, on the front surface side of the intermediary transfer belt 7, a secondary transfer upstream upper guiding member 22*a* as a feeding guide for regulating behavior such that the transfer material P approaches the surface of the intermediary transfer belt 7 is disposed. Further, a secondary transfer upstream lower guiding member 22*b* for regulating behavior such that the transfer material P is spaced from the surface of the intermediary transfer belt 7 is disposed. The transfer material P passes through between these guiding members 22*a* and 22*b*. That is, by these guiding members 22*a* and 22*b*, a feeding path of the transfer material P from the registration roller pair 21 to the secondary transfer portion N2 is regulated.

Then, at the secondary transfer portion N2, the toner images on the intermediary transfer belt 7 are electrostatically transferred (secondary-transferred) onto the transfer material P, sandwiched and fed between the intermediary transfer belt 7 and the secondary transfer belt 81, by the action of the secondary transfer device 10. At this time, to the secondary transfer roller 82, a secondary transfer bias (secondary transfer voltage) of an opposite polarity (positive in this embodiment) to the normal charge polarity of the toner is applied. As a result, a secondary transfer current is supplied to the secondary transfer portion N2. A deposited matter such as the toners (secondary-transfer residual toners) remaining on the intermediary transfer belt 7 after the secondary transfer step is removed and collected from the intermediary transfer belt 7 by the intermediary transfer belt cleaner 74.

The transfer material P on which the toner images are transferred is separated from the intermediary transfer belt 7 and then from the secondary transfer belt 81, and thereafter is fed to a fixing device 24 by a pre-fixing feeding device 23. Then, after unfixed toner images are fixed on the transfer material P by the fixing device 24, the transfer material P is discharged (outputted) to an outside of an apparatus main assembly of the image forming apparatus 100.

2. Secondary Transfer Device

Figure 2:
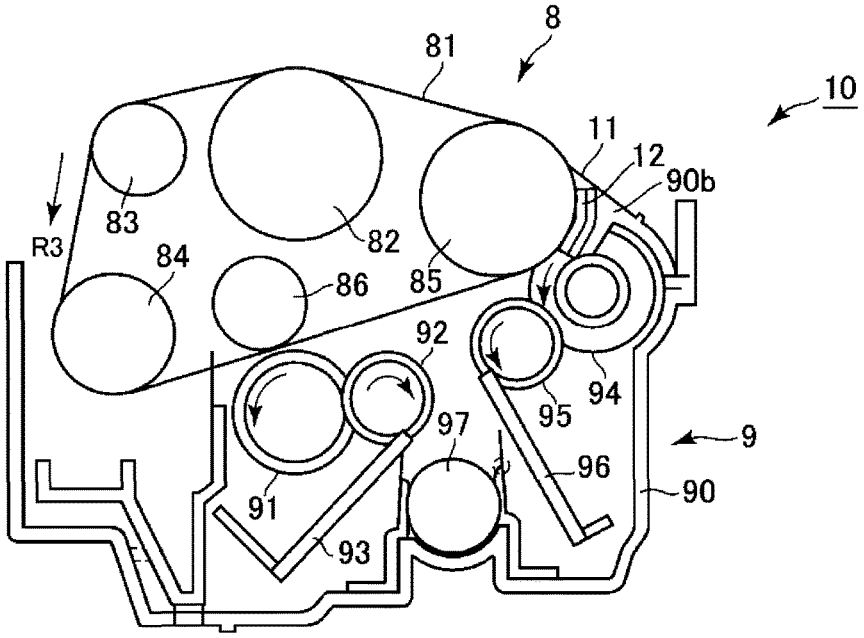
FIG. 2 is a schematic sectional view of a secondary transfer device.

Next, a basic structure of the secondary transfer device 10 in this embodiment will be specifically described. FIG. 2 is a schematic sectional view of the secondary transfer device 10. The secondary transfer device 10 is constituted by including a belt unit 8 and a cleaning unit 9.

First, the belt unit 8 will be described. The belt unit 8 includes the secondary transfer belt 81 constituted by the endless belt as a transfer member. The secondary transfer belt 81 is stretched by a plurality of stretching rollers (supporting members) including the secondary transfer roller 82, a separation roller 83, a tension roller 84 and a driving roller 85. The secondary transfer roller 82 sandwiches the intermediary transfer belt 7 and the secondary transfer belt 81 between itself and the secondary transfer opposite roller 73, so that the secondary transfer portion N2 is formed. The separation roller 83 separates the transfer material P, after passing through the secondary transfer portion N2, from the secondary transfer belt 81. The tension roller 84 is urged from the inner peripheral surface side toward the outer peripheral surface side of the secondary transfer belt 81 by a spring (not shown) as an urging means, so that a tension is imparted to the secondary transfer belt 81. The driving roller 85 transmits a driving force from a driving motor (not shown) as a driving means to the secondary transfer belt 81 and thus moves (rotates) the secondary transfer belt 81. The secondary transfer belt 81 is rotationally driven in an arrow R3 direction in FIG. 1 by the driving roller 85. Further, the belt unit 8 includes an opposing roller 86 as an opposing member to an upstream fur brush 91 described later.

The respective rollers are disposed along a rotational direction of the secondary transfer belt 81 in the order of the secondary transfer roller 82, the separation roller 83, the tension roller 84, the opposing roller 86 and the driving roller 85. Each of the secondary transfer roller 82, the separation roller 83, the tension roller 84 and the opposing roller 86 is rotated with rotation of the secondary transfer belt 81.

In this embodiment, as the secondary transfer belt 81, a belt prepared by incorporating carbon black as an antistatic agent in an appropriate amount into a resin material, such as polyimide or polycarbonate, or the like belt can be suitably used. The secondary transfer belt 81 is about $1\times10^{9}$-$1\times10^{14}$ Ω·cm in volume resistivity and about 0.07-0.1 mm in thickness. Further, the secondary transfer belt 81 used in this embodiment is about 100 MPa or more and 10 GPa or less in Young's modulus as measured by a tensile test method (JIS K 6301), and thus may preferably be sufficiently hard. In this embodiment, the secondary transfer belt 81 is formed of polyimide (PI).

In this embodiment, the secondary transfer roller 82 as a bias application member is constituted by providing, on a core metal (core material), an elastic layer formed with an ion-conductive foamed rubber (NBR rubber). This secondary transfer roller 82 is 24 mm in outer diameter, 6.0-12.0 μm in surface roughness Rz of the surface layer, and $1\times10^{5}$-$1\times10^{7}$Ω in electric resistance as measured under application of a voltage of 2 kV in an N/N (23° C./50% RH) environment. Further, to the secondary transfer roller 82, a secondary transfer bias voltage source (high-voltage source) 87 (FIG. 1) as a secondary transfer bias applying means is connected. The secondary transfer bias voltage source 87 is capable of supplying a variable bias and is constituted so that a desired secondary transfer bias can be applied to the secondary transfer roller 82. By applying the secondary transfer bias to the secondary transfer roller 82, not only are the toner images transferred from the intermediary transfer belt 7 onto the transfer material P fed to the secondary transfer portion, but also the transfer material P is attracted to the secondary transfer belt 81 by a supplied electrostatic force. In this embodiment, the secondary transfer bias is applied to the secondary transfer roller 82 so that a current of, e.g., +40 to +60 μA flows.

The secondary transfer belt 81 wound around the surface of the secondary transfer roller 82 is moved in the arrow R3 direction in FIG. 1, so that the transfer material P attracted to the surface of the secondary transfer belt 81 at the secondary transfer portion N2 is fed to a downstream side. Then, at a time when the transfer material P on the secondary transfer belt 81 reaches a position of the separation roller 83 disposed adjacent to and downstream of the secondary transfer roller 82 with respect to the rotational direction of the secondary transfer belt 81, the transfer material P is separated from the surface of the secondary transfer belt 81 by curvature of the separation roller 83. Then, the transfer material P separated from the secondary transfer belt 81 is fed to the fixing device 24 as described above.

Next, the cleaning unit 9 will be described. Onto the secondary transfer belt 81 which is an object-to-be-cleaned of the cleaning unit 9, the following toners are transferred. The toners include fog toner in a sheet interval between images during continuous image formation, toner for an adjusting toner image such as a density patch, toner for a toner image which was formed on the intermediary transfer belt 7 during (paper) jamming, and toner of the like. A deposited matter such as the toner causes back surface contamination of the transfer material P, and therefore, it is desired that the deposited matter is removed from the secondary transfer belt 81. For that reason, in this embodiment, in the secondary transfer device 10, the cleaning unit 9 using an electrostatic fur brush cleaning type is provided.

Figure 3:
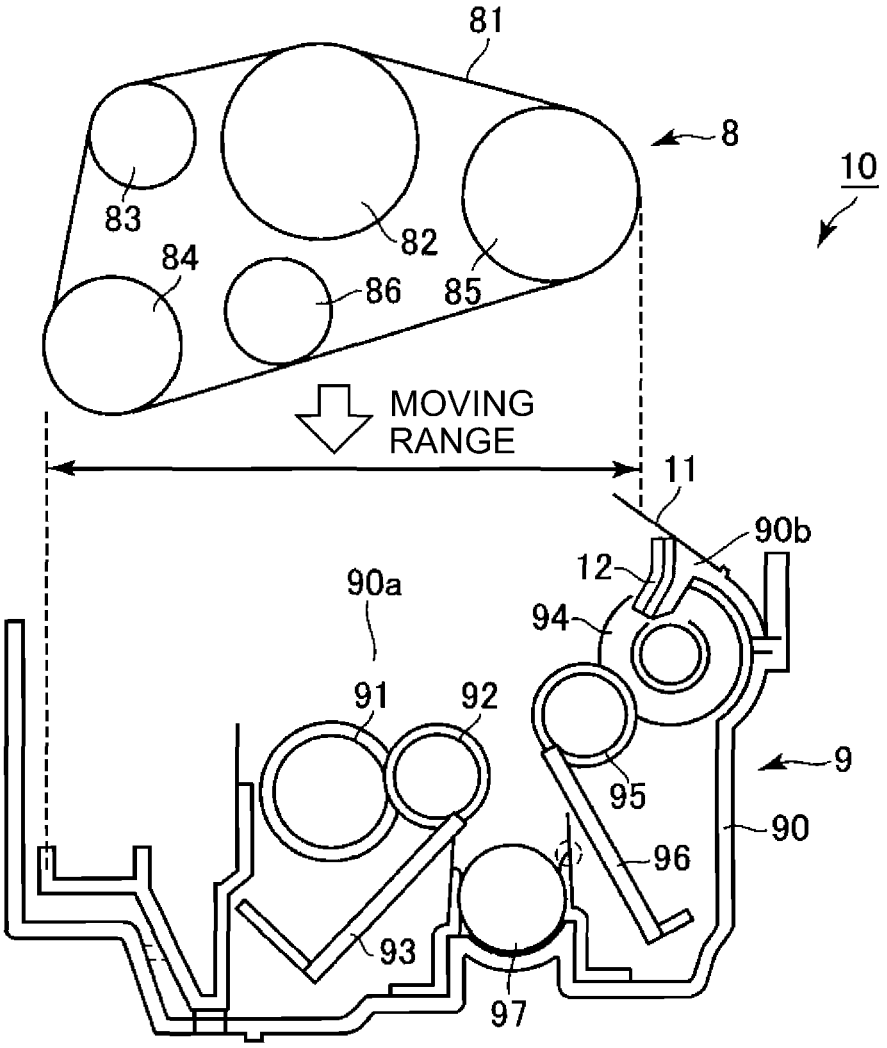
FIG. 3 is a schematic sectional view of the secondary transfer device for illustrating a state of mounting of a belt unit to a cleaning container.

The cleaning unit 9 includes a cleaning container 90. The cleaning container 90 is an example of a state accommodating powder and provided with an opening. The cleaning container 90 also has a function as a supporting member (casing, frame) for the above-described belt unit 8. Although the belt unit 8 will be specifically described later, as shown in FIG. 3, the belt unit 8 is detachably mounted to the cleaning container 90. In a state in which the belt unit 8 is mounted to the cleaning container 90, the secondary transfer belt 81 exposes to an outside of the cleaning container 90 from a part of a portion wound about the driving roller 85 to a part of a portion wound about the separation roller 83 with respect to movement direction of the surface thereof. In this state, the secondary transfer belt 81 rotates. The secondary transfer belt 81 of the belt unit 8 is an example of a rotatable member which is mounted to the container and which is rotatable while exposing at least a part of the surface thereof to the outside through the opening of the container.

Further, the cleaning unit 9 includes an upstream fur brush 91 and a downstream fur brush 94 which are rotatable roller-shaped fur brushes (fur brush rollers) as cleaning members. With respect to the rotational direction, the upstream fur brush 91 is disposed in an upstream side and the downstream fur brush 94 is disposed in a downstream side. Specifically, the upstream fur brush 91 is disposed at a position downstream of the tension roller 84 and upstream of the driving roller 85 with respect to the rotational direction of the secondary transfer belt 81 so as to contact the outer peripheral surface (front surface) of the secondary transfer belt 81. At a position opposing the upstream fur brush 91 via the secondary transfer belt 81, the opposing roller 86 as the opposing member is disposed in contact with the inner peripheral surface (back surface). In this embodiment, the opposing roller 86 is constituted by a metal roller and is grounded electrically. The downstream fur brush 94 is disposed so as to contact the outer peripheral surface of the secondary transfer belt 81 wound around the driving roller 85. In this embodiment, each of the upstream fur brush 91 and the downstream fur brush 94 is constituted by planting electroconductive nylon brushes in a core material. Each of the upstream fur brush 91 and the downstream fur brush 94 is rotationally driven in an arrow direction in FIG. 1.

Further, an upstream collecting roller 92 rotatable in contact with the upstream fur brush 91 is provided inside the cleaning container 90 of the cleaning unit 9. The upstream collecting roller 92 not only collects the deposited matter such as the toner collected from the surface of the secondary transfer belt 81 by the upstream fur brush 91 but also functions as a bias applying member (bias roller) for applying a bias (voltage) to the upstream fur brush 91.

Further, a downstream collecting roller 95 rotatable in contact with the downstream fur brush 94 is provided inside the cleaning container 90 of the cleaning unit 9. The downstream collecting roller 95 not only collects the deposited matter such as the toner collected from the surface of the secondary transfer belt 81 by the downstream fur brush 94 but also functions as a bias applying member for applying a bias (voltage) to the downstream fur brush 94. To each of the upstream collecting roller 92 and the downstream collecting roller 95, a collecting bias voltage source (not shown) is connected. Further, to the upstream collecting roller 92, a bias (voltage) of an opposite polarity (positive in this embodiment) to a normal charge polarity of the toner is applied, and to the downstream collecting roller 95, a bias of the same polarity (negative in this embodiment) as the normal charge polarity of the toner is applied. Each of the upstream collecting roller 92 and the downstream collecting roller 95 is rotationally driven in an arrow direction in FIG. 1.

Further, inside the cleaning container 90, the cleaning unit 9 includes an upstream cleaning blade 93 as a removing member provided in contact with the upstream collecting roller 92. The upstream cleaning blade 93 scrapes the deposited matter such as the toner off the upstream collecting roller 92, and the deposited matter is collected in a toner collecting unit 10 described later. Further, inside the cleaning container 90, the cleaning unit 9 includes a downstream cleaning blade 96 as the removing member provided in contact with the downstream collecting roller 95. The downstream collecting blade 96 scrapes the deposited matter such as the toner off the downstream collecting roller 95. Further, inside the cleaning container 90, the cleaning unit 9 includes a collecting screw 97 as a feeding member.

The toner transferred on the secondary transfer belt 81 is transferred from the secondary transfer belt 81 onto the upstream fur brush 91 to which the positive bias (voltage) is applied by the upstream collecting roller 92. Then, the toner transferred on the upstream fur brush 91 is transferred onto the upstream collecting roller 92 and then is scraped off the upstream collecting roller 92 by the upstream cleaning blade 93. To the upstream collecting roller 92, the positive bias is applied, so that the toner charged to the normal charge polarity of the toner is collected from the secondary transfer belt 81 by the upstream fur brush 91. Most of the negative toner is transferred onto the upstream collecting roller 92 and is scraped off the roller 92 by the upstream cleaning blade 93. However, there is a toner which is transferred from the secondary transfer belt 81 onto the upstream fur brush 91 but which passes through a contact portion between the upstream fur brush 91 and the upstream collecting roller 92 without being transferred from the upstream fur brush 91 onto the upstream collecting roller 92. This toner can be returned from the upstream fur brush 91 to the secondary transfer belt 81 when the toner contacts the secondary transfer belt 81 again. In many cases, this toner is the positive toner, and therefore, is transferred onto the downstream fur brush 94 supplied with the negative bias, by the downstream collecting roller 95. The toner is transferred from the downstream fur brush 94 onto the downstream collecting roller 95, and then is scraped off the roller 95 by the downstream cleaning blade 96.

The toners collected by the upstream cleaning blade 93 and the downstream cleaning blade 96 as described above drop onto the collecting screw 97 immediately below the blades. Then, the toners are carried to a collecting toner path (not shown) by the collecting screw 97 and are finally fed into a residual (waste) toner container (not shown).

3. Seal Member

A seal (sealing) member for sealing a gap between the cleaning container 90 and the secondary transfer belt 81 in the secondary transfer device 10 will be described. Here, a direction substantially perpendicular to a surface movement direction of the secondary transfer belt 81 (i.e., substantially parallel to rotational axes of the stretching rollers 82, 83, 84 and 85) is also referred to as a "thrust direction". Further, with respect to the thrust direction, an end portion side corresponding to a front side of the drawing sheet of FIG. 2 is a "front side", and an end portion side corresponding to a rear side of the drawing sheet of FIG. 2 is a "rear side".

Referring to FIG. 2, inside the cleaning container 90, the toners scraped off by the fur brushes 91 and 94 and the cleaning blades 93 and 96 are filled. For that reason, the toners are likely to leak out to the outside of the cleaning container 90 through the gap between the belt unit 8 and the cleaning container 90. In the neighborhood of the fur brushes 91 and 94, the fur brushes 91 and 94 scrapes the toners off the surface of the secondary transfer belt 81 and scatter the toners with rotation thereof. Particularly, in the neighborhood of the downstream fur brush 94, there is an edge portion (edge portion of the cleaning container 90 in an upstream side with respect to the surface movement direction of the secondary transfer belt 81 exposed from the cleaning container 90) **90*b* which forms an opening 90*a* (FIG. 3) of the cleaning container 90 and which extends in the thrust direction. For that reason, the toner is liable to blow out through a gap between the edge portion 90*b* and the secondary transfer belt 81 while moving along air flow by rotation of the secondary transfer belt 81**.

For that reason, the gap between the edge portion **90*b* of the cleaning container 90 and the secondary transfer belt 81 is sealed with the seal member. In this embodiment, as the seal member, a sheet member 11 which is a sheet-shaped seal member relatively low in rigidity is used. Particularly, in this embodiment, as the sheet member 11**, an urethane sheet which is a sheet formed of polyurethane is used.

The sheet member 11 is a flexible sheet which is disposed along the thrust direction, which has a predetermined length with respect to each of a longitudinal direction and a widthwise direction substantially perpendicular to the longitudinal direction and which has a substantially rectangular shape in plan view. Further, the sheet member 11 is fixed to the edge portion **90*b* of the cleaning container 90 along the thrust direction in a predetermined range in one end portion (fixed end) side with respect to the widthwise direction, and contacts the surface of the secondary transfer belt 81 wound about the driving roller 85 in a predetermined range in the other end portion (free end) side. In this embodiment, the sheet member 11 contacts the secondary transfer belt 81 in a substantially entire region of the secondary transfer belt 81 with respect to the thrust direction. Further, in this embodiment, the sheet member 11 is disposed in contact with the surface of the secondary transfer belt 81 from above and deforms so as to follow the surface of the secondary transfer belt 81 by its own weight, and thus surface-contacts the surface of the secondary transfer belt 81 ((b) of FIG. 5). As a result, the sheet member 11 performs a function of suppressing scattering of the toner through the gap between the edge portion 90*b* of the cleaning container 90 and the secondary transfer belt 81. That is, the sheet member 11 contacts the surface of the secondary transfer belt 81 along the thrust direction in a (codirectional) state in which the free end thereof faces toward a downstream side with respect to the surface movement direction of the secondary transfer belt 81 (i.e., in a normal state described later), and thus seals between the secondary transfer belt 81 and the cleaning container 90**.

Here, as the seal member contacting the secondary transfer belt 81 in the substantially entire region with respect to the thrust direction, when a brush-shaped member or a foam material which is urged against the surface of the secondary transfer belt 81 is used, these members collect the scattered toner. For this reason, by friction with the surface of the secondary transfer belt 81, fusion of the toner generates, so that an image defect is caused and a load torque becomes large. Further, when the sheet member such as the PET sheet relatively high in rigidity is used as the seal member, there is a possibility that the secondary transfer belt 81 is damaged and a sealing performance changes by abrasion due to use of the sheet member. For that reason, as in this embodiment, it is preferable that the sheet member which is relatively low in rigidity and which is capable of relatively lowering the contact pressure is used.

3. Mounting Operation

Figure 4:
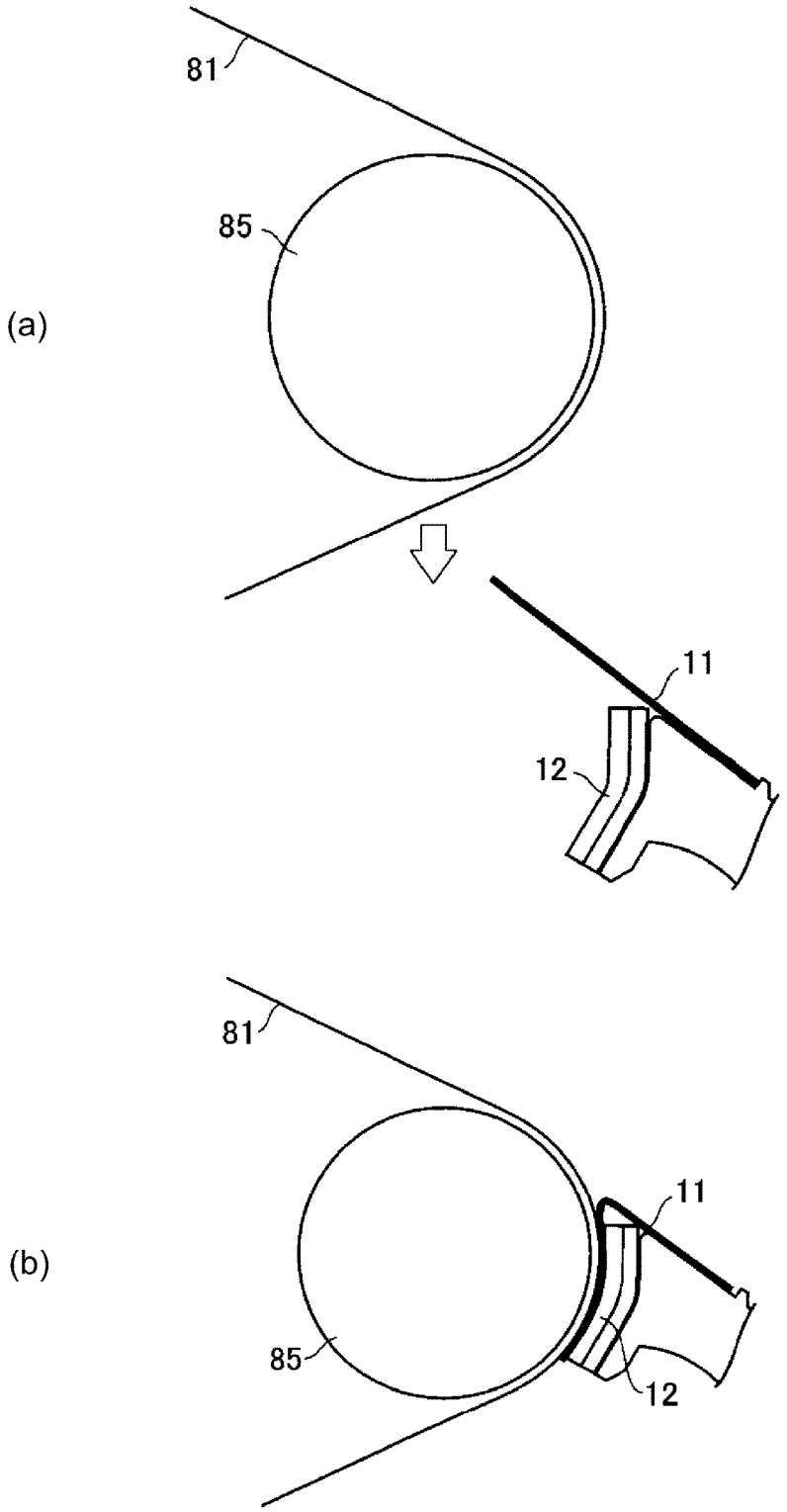
In FIG. 4, (a) and (b) are enlarged sectional views for illustrating a behavior of a sheet member during the mounting of the belt unit.

A mounting operation of the belt unit 8 to the cleaning container 90 will be described. FIG. 3 is a schematic sectional view of the secondary transfer device 10 for illustrating a state during mounting of the belt unit 8 to the cleaning container 90. In FIG. 4, (a) and (b) are enlarged sectional views for illustrating a behavior of the sheet member 11 during the mounting of the belt unit 8.

In this embodiment, the belt unit 8 is disposed above the cleaning unit 9 with respect to the vertical direction. Then, the mounting of the belt unit 8 to the cleaning container 90 is made so that the belt unit 8 is dropped into the cleaning container 90 from above. Further, the sheet member 11 is disposed so that the free end thereof is positioned within a moving range of the belt unit 8 when the belt unit 8 is assembled with the cleaning container 90 (FIG. 3, (a) of FIG. 4). That is, the free end of the sheet member 11 is positioned within a moving locus of the secondary transfer belt 81 when the secondary transfer belt 81 is mounted to the cleaning container 90. In other words, when the secondary transfer belt 81 is mounted to the cleaning container 90, the free end of the sheet member 11 is positioned inside a region formed by a contour of the secondary transfer belt 81 as seen in the movement direction of the secondary transfer belt 81. For that reason, the sheet member 11 is trampled by the secondary transfer belt 81 when the secondary transfer unit 8 is mounted to the cleaning container 90, and thus is in a state in which the sheet member 11 is caught inside the cleaning container 90 ((b) of FIG. 4). In this case, the free end of the sheet member 11 is in a (counterdirectional) state in which the free end faces an upstream side with respect to the surface movement direction of the secondary transfer belt 81.

Incidentally, in FIG. 3 and (a) and (b) of FIG. 4, the sheet member 11 is illustrated on the assumption that the sheet member 11 extends along a rectilinear line in the widthwise direction in a state before the mounting of the belt unit 8. However, even in the state before the mounting of the belt unit 8, the sheet member 11 bends downwardly toward the inside of the cleaning container 90 depending on rigidity thereof in some cases.

Here, in the state in which the sheet member 11 is caught as shown in (b) of FIG. 4, an attitude of the free end of the sheet member 11 is not stabilized, and therefore, a stable sealing effect over the substantially entire region of the sheet member 11 with respect to the thrust direction cannot be expected. For that reason, it would be considered that an operator manually pulled out (turns up) the sheet member 11 to a normal position. However, in order to pull out the sheet member 11 manually, in general, the operation is performed in a narrow place and therefore a tool having a sharp tip or the like is required to be used in some cases. For that reason, the secondary transfer belt 81 and the sheet member 11 are liable to be damaged, so that the image defect and worsening of a degree of the toner scattering can be caused.

Further, it would be considered that the sheet member 11 is made detachable from the cleaning container 90 and is mounted to the cleaning container 90 after the belt unit 8 is mounted to the cleaning container 90. Alternatively, it would be considered that a mechanism for retracting the sheet member 11 from the belt unit 8 in synchronism with mounting and demounting of the belt unit 8 relative to the cleaning container 90 is provided. However, in these methods, the operation is complicated, and an increase in number of parts and a complicated mechanism are required.

Further, it would be also considered that the sheet member 11 is mounted in the belt unit 8 side, but an operation when part exchange of the belt unit 8 itself is performed becomes complicated.

For these reasons or the like, in this embodiment, the sheet member 11 is mounted in the cleaning container 90 side and is held is a state in which the sheet member 11 enters the moving rang of the belt unit 8.

Incidentally, the mounting of the belt unit 8 to the cleaning container 90 is performed not only during assembling of the image forming apparatus 100 but also when the belt unit 8 is mounted to or demounted from the cleaning container 90 in order to replace the belt unit 8 (particularly the secondary transfer belt 81).

4. Automatic Pulling-Out of Sheet Member

Figure 5:
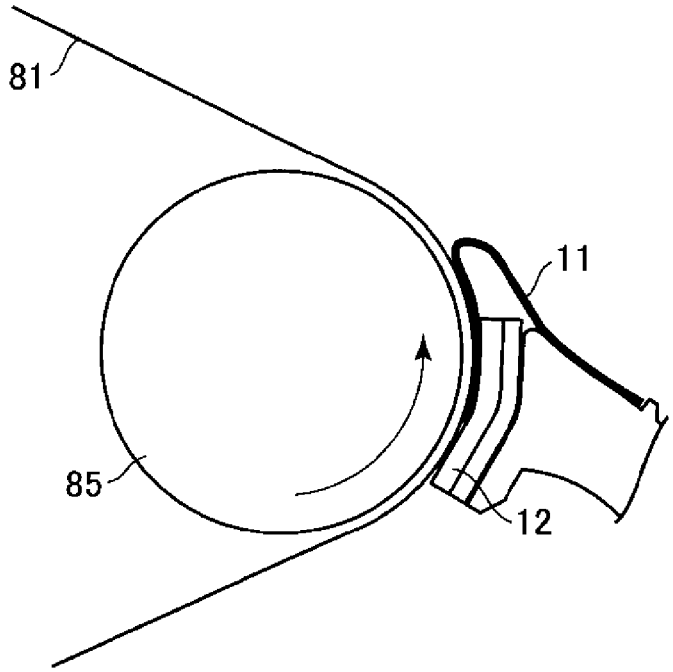
In FIG. 5, (a) and (b) are enlarged sectional views for illustrating a behavior of the sheet member during automatic pulling-out of the sheet member.
Figure 5:
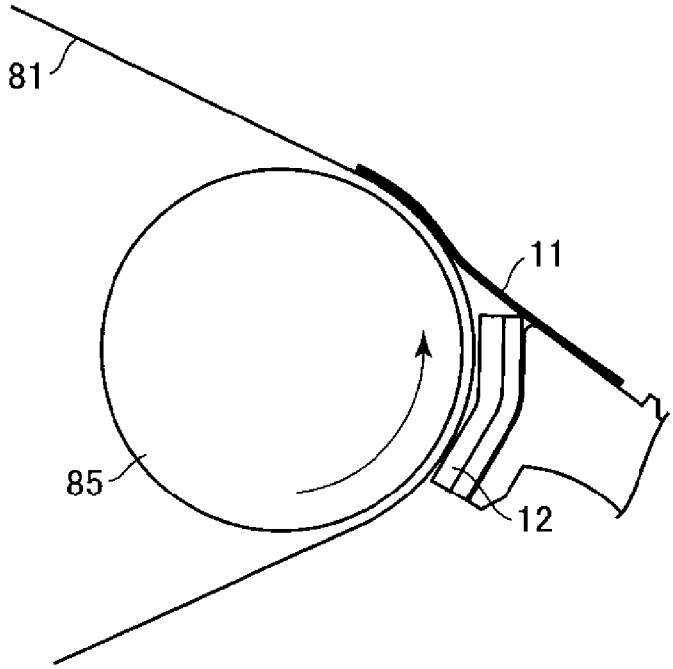

Next, automatic pulling-out of the sheet member 11 in this embodiment will be described. In FIG. 5, (a) and (b) are enlarged views for illustrating a behavior of the sheet member 11 during the automatic pulling-out of the sheet member 11. Incidentally, herein, a state of the sheet member 11 as shown in (b) of FIG. 4 described above is also referred to as a "caught state", and a state of the sheet member 11 as shown in (b) of FIG. 5 also referred to as a "normal state".

In this embodiment, the urging member 12 which is urged against the surface of the secondary transfer belt 81 in a normal operation state and which does not contact the sheet member 11 is provided in the cleaning container 90. The normal operation state is a state of the belt unit 8 after the sheet member 11 is placed in the normal state by an operation performed first after the mounting of the belt unit 8 described later. The urging member 12 is disposed so as to sandwich and urge, between itself and the secondary transfer belt 81, the sheet member 11 placed in the caught state by the belt unit 8, when the belt unit 8 is mounted to the cleaning container 90. Typically, as this time, the sheet member 11 is sandwiched only by the urging member 12 between the secondary transfer belt 81 and the urging member 12. Then, during the operation performed first after the mounting of the belt unit 8, the sheet member 11 in the caught state is automatically pulled out (turned up, raised) by rotation of the secondary transfer belt 81, and thus is placed in the normal state. For this reason, during the mounting of the belt unit 8 to the cleaning container 90, even when the sheet member 11 is in the caught state, the operator is not required to perform a particular operation. Then, during subsequent first actuation of the image forming apparatus 100 (i.e., the belt unit 8), the sheet member 11 is automatically put in the normal state in which the sheet member 11 is disposed at the normal position. This will be specifically described.

Referring to FIGS. 2 to 5, in this embodiment, the urging member 12 is provided in the neighborhood of the sheet member 11. Specifically, the urging member 12 is mounted to the cleaning container 90 at a position upstream of the sheet member 11 in the normal state with respect to the surface movement direction of the secondary transfer belt 81 and corresponding to each of end portions of the driving roller 85 with respect to the thrust direction. The urging member 12 is fixed to a surface of the cleaning container 90 opposing the secondary transfer belt 81 wound about the driving roller 85 adjacent to the edge portion 90*b* of the cleaning container 90 and extending toward the inside of the cleaning container 90. In this embodiment, as the urging member 12, a pile formed with PTFE fibers is used.

The urging member 12 is urged against the surface of the secondary transfer belt 81 wound about the driving roller 85 when the sheet member 11 is in the normal state. In this embodiment, the urging member 12 is compressed together with the secondary transfer belt 81 between the driving roller 85 and the cleaning container 90 by mounting the belt unit 8 to the cleaning container 90. As a result, the urging member 12 is urged against the surface of the secondary transfer belt 81. The urging member 12 also has a function as an end portion seal (sealing) member for suppressing the toner scattering with respect to the thrust direction in each of the front side and the rear side of the driving roller 85 in the neighborhood of the edge portion 90*b* when the sheet member 11 is in the normal state.

Figure 6:
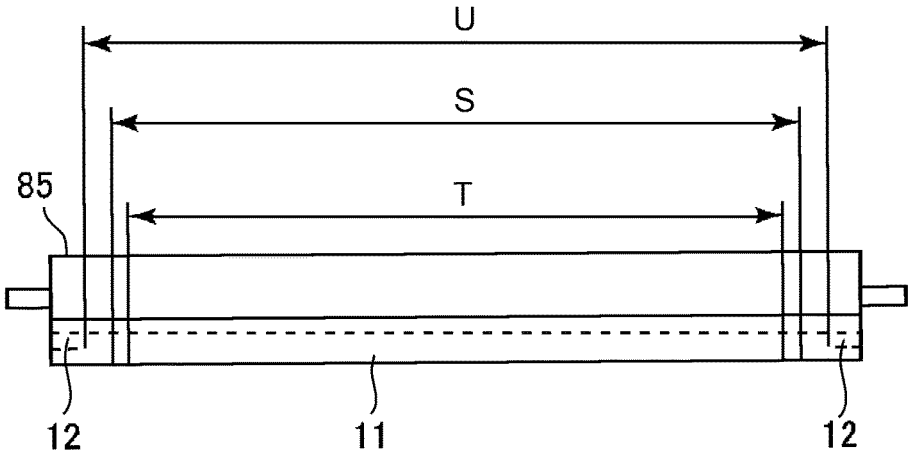
FIG. 6 is a schematic view showing a positional relationship among a driving roller of a secondary transfer belt, the sheet member and an urging member.

FIG. 6 is a schematic view showing a positional relationship among the driving roller 85, the sheet member 11 and the urging member 12. With respect to the thrust direction, a maximum of a length of the transfer material P fed to the secondary transfer portion N2 is a sheet passing width S. Further, with respect to the thrust direction, a maximum of a length of the image formed on the intermediary transfer belt 8 is an image region T. Further, with respect to the thrust direction, a distance between the front-side urging member 12 and the rear-side urging member 12 is a region U between the urging members 12. At this time, in this embodiment, the relationship: T<S<U (provided that a smaller region is included in a larger region) is satisfied. Particularly, the relationship T<U (provided that the smaller region is included in the larger region) is satisfied, so that the fusion of the toner can be suppressed. That is, when the urging member 12 is disposed within the image region T, the urging member 12 collects the toner, so that the fusion of the toner is liable to generate by friction of the urging member 12 with the secondary transfer belt 81 but can be suppressed by disposing the urging member 12 in a region out of the image region T.

As described above, when the belt unit 8 is mounted to the cleaning container 90, the sheet member 11 is caught. At this time, in this embodiment, the cleaning container 90 is provided with the urging member 12, and therefore, as shown in (b) of FIG. 12, the sheet member 11 is sandwiched between the secondary transfer belt 81 and the urging member 12 at each of end portions thereof with respect to the thrust direction. In this embodiment, only the urging member 12 sandwiches the sheet member 11 between itself and the secondary transfer belt 81.

Thus, the urging member 12 urged against (press-contacted to) the surface of the secondary transfer belt 81 is provided upstream of a contact portion between the sheet member 11 in the normal state and the secondary transfer belt 81 with respect to the surface movement direction of the secondary transfer belt 81. Further, the urging member 12 is disposed at a position where the sheet member 11 can be sandwiched between the urging member 12 and the secondary transfer belt 81 in the case where the free end of the sheet member 11 is deformed so as to face the upstream side of the secondary transfer belt 81 with respect to the surface movement direction of the secondary transfer belt 81. That is, the urging member 12 is disposed at a position where the urging member 12 can sandwich the sheet member 11 in a state in which the free end of the sheet member 11 is deformed so as to face the upstream side of the secondary transfer belt 81 with respect to the surface movement direction, between itself and the secondary transfer belt 81.

Figure 7:
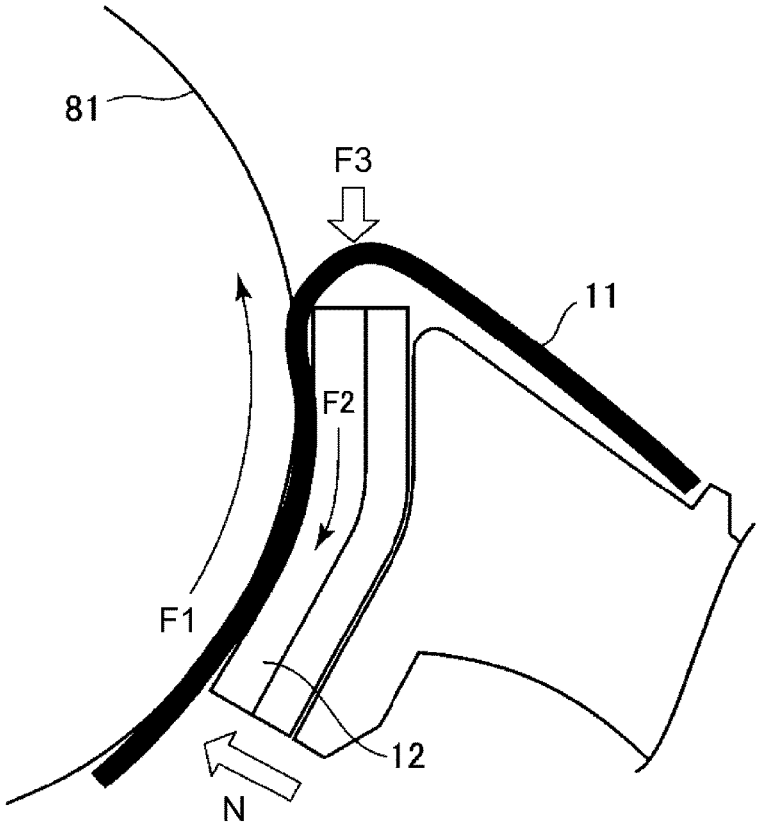
FIG. 7 is a schematic view for illustrating a force exerted during the automatic pulling-out of the sheet member.

FIG. 7 is a schematic view showing forces exerted on the sheet member 11 in the caught state or the like member. A friction coefficient between the sheet member 11 and the secondary transfer belt 81 is μ1, and a friction coefficient between the sheet member 11 and the urging member 12 is μ2. Specifically, μ1 is a friction coefficient between a surface (a surface of the sheet member 11 in the normal state in an opposite side from the secondary transfer belt 81) of the sheet member 11 in the caught state in a side facing the secondary transfer belt 81 (rotatable member) and the surface of the secondary transfer belt 81. Further, μ2 is a friction coefficient between a surface (a surface of the sheet member in the normal state in a side facing the secondary transfer belt 81) of the sheet member 11 in the caught state in a side facing the urging member 12 and the surface of the urging member 12. At this time, the relationship: μ1>μ2 is satisfied.

Further, when the sheet member 11 is in the caught state, the urging member 12 urges the sheet member 11 toward the driving roller 85 via the secondary transfer belt 81. For that reason, stress N exerted on a boundary between the sheet member 11 and the secondary transfer belt 81 and stress N exerted on a boundary between the sheet member 11 and the urging member 12 are equal to each other.

Here, a force μ1×N for pulling out (turning up) the sheet member 11 by the secondary transfer belt 81 on the driving roller 85 is F1, and a force μm2×N for holding the sheet member 11 by the urging member is F2. Further, when the sheet member 11 changes from the state of (b) of FIG. 4 to the state of (a) of FIG. 5, the sheet member 11 to be pulled out is gradually moved to the normal position (normal state) while being gradually bent. Of reaction forces generated during the bending due to the resilience of the sheet member 11, i.e., of bending elastic forces of the sheet member 11, a component force with respect to the rotational direction of the driving roller 85 is F3. In this case, when a relationship between the force F1 for pulling out the sheet member 11 and a resultant of the force F2 for holding the sheet member 11 and the component force F3 of the bending elastic forces due to the resilience of the sheet member 11 is F1>(F2+F3), the sheet member 11 is pulled out. If the sheet member such as PET sheet relatively high in rigidity is used as the sheet member and F1<(F2+F3) is satisfied, the sheet member cannot be pulled out.

As an example, in this embodiment, as the sheet member 11, a 100 μm-thick urethane sheet ("ESMER URS", manufactured by Nihon Matai Co., Ltd.) is used. In place of this urethane sheet, in the case where a 50 μm-thick PET sheet is used, a thickness thereof is thin, but is higher in rigidity than the urethane sheet, so that the above-described force F3 becomes large and therefore the automatic pulling-out as described above cannot be realized. Further, the higher rigidity of the sheet member 11 is liable to impair a mounting and demounting operation of the belt unit 8, and is also liable to increase in risk of buckling, peeling and the like.

As an example, the friction coefficients μ1 and μ2 in this embodiment are as follows. The friction coefficient μ1 was calculated by pressing a roller about which a test piece formed with an urethane sheet substantially identical to the sheet member 11 in this embodiment was wound, against a test piece formed of μ1 identical to the μ1 of the secondary transfer belt 81 in this embodiment by a weight of 300 g and then by obtaining a value thereof from a force with respect to a tangential direction when the roller was rotated. Similarly, the friction coefficient μ2 was calculated by pressing a roller about which the urethane sheet substantially identical to the sheet member 11 in this embodiment was wound, against a test piece formed of PTFE identical to the PTFE of the urging member 12 in this embodiment by a weight of 300 g and then by obtaining a value thereof from a force with respect to a tangential direction when the roller was rotated.

When the friction coefficients were measured in an environment of 20° C. in ambient temperature and 30% in relative humidity, a static friction coefficient μ1 was 1.59, and a static friction coefficient was 0.66. Thus, in this embodiment, the above-described relationship: μ1>μ2 is satisfied.

Incidentally, values of the above-described friction coefficients μ1 and μ2 correspond to those when all of the sheet member 11, the secondary transfer belt 81 and the urging member 12 are new (fresh). When the sheet member 11 is used in the image forming apparatus 100, the toner is deposited on the surface thereof in the normal state in a side facing the secondary transfer belt 81. On the other hand, the toner is not significantly deposited on the surface thereof in the normal state in an opposite side from the secondary transfer belt 81. Further, when the sheet member 11 is used in the image forming apparatus 100, the toner is also deposited on the surface of the urging member 12 contacting the secondary transfer belt 81 in some cases. Here, in general, a frequency of replacement of the secondary transfer belt 81 is higher than a frequency of replacement of the sheet member 11 and the urging member 12. Therefore, compared with the cleaning container 90 (i.e., the sheet member 11 and the urging member 12) used in the image forming apparatus 100, the case where the belt unit 8 (i.e., the secondary transfer belt 81) is replaced will be considered. In this case, when the sheet member 11 is in the caught state, the surface of the sheet member 11 where the toner is deposited and the surface of the urging member 12 where the toner is deposited contact each other. Then, the surface of the new (fresh) secondary transfer belt 81 and the surface of the sheet member 11 where the toner is minimally deposited contact each other. When powder such as the toner exists between the two members, the friction coefficient between the two members tends to lower. However, only between the sheet member 11 in the caught state and the urging member 12, the toner is significantly deposited, and therefore, even after the sheet member 11 and the urging member 12 are used in the image forming apparatus 100, the above-described relationship: μ1>μ2 is maintained.

Incidentally, during the replacement or the like of the belt unit 8, the sheet member 11 is returned from the caught state to the normal state in a relatively short time. However, for example, it would be also considered that the sheet member 11 is maintained in the caught state for a relatively long time such as in a period from assembling of the image forming apparatus 100 until the image forming apparatus 100 is first actuated. When the sheet member 11 is maintained in a bent state for a relatively long time, the sheet member 11 gets into a habit of being bent in some cases. However, depending on a material and a dimension (such as a length with respect to the widthwise direction) of the sheet member 11, even when the sheet member 11 gets into the habit, the sheet member 11 is deformed by its self-weight, so that the sheet member 11 can contact the surface of the secondary transfer belt 81 so as to sufficiently follow the surface of the secondary transfer belt 81 and thus can achieve a sufficient sealing effect. Accordingly, a time in which the sheet member 11 can be maintained in the caught state may appropriately set depending on the material, the dimension or the like of the sheet member 11.

As described above, according to this embodiment, the sheet member 11 sandwiched between the secondary transfer belt 81 and the urging member 12 by being trampled by the secondary transfer belt 81 is automatically pulled out by the rotation of the urging member 12 during an operation of the belt unit 8 performed first subsequently. As a result, it is possible to dispose the sheet member 11 at the normal position without requiring a complicated operation and a complicated mechanism.

Other Embodiments

The present invention was described based on the specific embodiment, but is not limited to the above-described embodiment.

For example, in the above-described embodiment, the rotatable member was the secondary transfer belt as the transfer member for transferring the toner image from the intermediary transfer member onto the transfer material, and the container was the cleaning container for accommodating the toner collected from the secondary transfer belt, but the present invention is not limited thereto. For example, the rotatable member may also be the secondary transfer roller as the transfer member for transferring the toner image from the intermediary transfer member onto the transfer material, or the photosensitive member or the developer carrying member or the like. Further, the container may also be the cleaning container for accommodating the toner collected from the secondary transfer roller or the photosensitive member or the developer container for accommodating the toner to be supplied to the developer carrying member. That is, the present invention can be applied when a sheet member similar to the sheet member in the above-described embodiment can be used as the seal member for sealing between the container accommodating the powder and the rotatable member mounted to the container, and an effect similar to the effect of the above-described embodiment can be obtained. The accommodation of the powder in the container is not limited to storage of the powder, such as the toner before use or the residual (waste) toner after the use, in the container, but may also include the case where the powder such as the toner which simply scatters is confined in the container so as to be prevented from leaking out of the container.

In the above-described embodiment, the urging member was urged toward the rotatable member by being compressed between the rotatable member and the container, but the present invention is not limited thereto. The urging member may also be urged toward the rotatable member by a separate member, from the container, such as a spring as an urging means.

Further, the mounting of the rotatable member to the container is not limited to support of the rotatable member by the container, but may also include the case where the rotatable member is supported by a separate supporting member from the container and is disposed at a predetermined position relative to the container.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-151221 filed on Jul. 30, 2015, which is hereby incorporated by reference herein in its entirety.

What is claimed is:

1. An image forming apparatus comprising:

a movable member unit including a movable member on which a toner image is carried or a movable member configured to feed a recording material on which the toner image is carried, wherein said movable member unit movably supports said movable member; and a container connectable with said movable member unit and including a cleaning member, a sheet member and an urging member, wherein said cleaning member removes a toner on said movable member with movement of said movable member in contact with said movable member in a state in which said movable member unit and said container are connected with each other, wherein said sheet member extends in a widthwise direction perpendicular to a movement direction of said movable member and is supported by said container in one end side thereof with respect to the movement direction of said movable member, and at least during cleaning of said movable member, a part of said sheet member in the other end side, where a free end of said sheet member is positioned, is in a first state in which the part of said sheet member contacts said movable member codirectionally with the movement direction of said movable member, wherein said urging member is adjacent to said sheet member in an upstream side of said sheet member with respect to the movement direction of said movable member and is disposed at a position overlapping with neighborhoods of ends of said sheet member with respect to the widthwise direction, and the part of said sheet member in the other end side, where the free end of said sheet member is positioned, is in a second state in which the part of said sheet member is sandwiched between said movable member and said urging member counterdirectionally with the movement direction of said movable member after said movable member unit and said container are connected with each other and before said movable member is first moved, and wherein when a friction coefficient between said sheet member and said movable member is $\mu 1$ and a friction coefficient between said sheet member and said urging member is $\mu 2$, the following relationship is satisfied:

$\mu 2 > \mu 2$.

2. An image forming apparatus according to claim 1, wherein $\mu 1$ is a friction coefficient between a new sheet member and a new movable member and $\mu 2$ is a friction coefficient between the new sheet member and a new urging member.

3. An image forming apparatus according to claim 1, wherein $\mu 1$ is a friction coefficient between said sheet member and a surface of said movable member in the second state and $\mu 2$ is a friction coefficient between said sheet member and a surface of said urging member in the second state.

4. An image forming apparatus according to claim 1, wherein said sheet member surface-contacts said movable member so as to follow a surface of said movable member by its own weight.

5. An image forming apparatus according to claim 1, wherein said sheet member is a sheet formed of polyurethane.

6. An image forming apparatus according to claim 1, wherein said urging member is a pile formed of PTFE fibers.

7. An image forming apparatus according to claim 1, wherein said movable member is an endless belt stretched by a plurality of stretching rollers.

8. An image forming apparatus according to claim 7, wherein said urging member is disposed at a position opposing one of the stretching rollers via the belt.

9. An image forming apparatus according to claim 1, wherein said container accommodates a toner collected from a surface of said movable member.

10. An image forming apparatus comprising:

a movable member unit including a movable member on which a toner image is carried or a movable member configured to feed a recording material on which the toner image is carried, wherein said movable member unit movably supports said movable member; and a container connectable with said movable member unit and including a cleaning member, a sheet member and an urging member, wherein said cleaning member removes a toner on said movable member with movement of said movable member in contact with said movable member in a state in which said movable member unit and said container are connected with each other, wherein said sheet member extends in a widthwise direction perpendicular to a movement direction of said movable member and is supported by said container in one end side thereof with respect to the movement direction of said movable member, and at least during cleaning of said movable member, a part of said sheet member in the other end side, where a free end of said sheet member is positioned, is in a first state in which the part of said sheet member contacts said movable member codirectionally with the movement direction of said movable member, wherein said urging member is adjacent to said sheet member in an upstream side of said sheet member with respect to the movement direction of said movable member and is disposed at a position overlapping with neighborhoods of ends of said sheet member with respect to the widthwise direction, and the part of said sheet member in the other end side, where the free end of said sheet member is positioned, is in a second state in which the part of said sheet member is sandwiched between said movable member and said urging member counterdirectionally with the movement direction of said movable member after said movable member unit and said container are connected with each other and before said movable member is first moved, and wherein the part of said sheet member in the other end side in the second state changes in state to the first state with movement of said movable member.

* * * * *